US008550124B2

(12) United States Patent
Tsai

(10) Patent No.: US 8,550,124 B2
(45) Date of Patent: Oct. 8, 2013

(54) WOVEN FABRIC WITH A COLOR GLITTERING EFFECT

(75) Inventor: Chih-Cheng Tsai, Tainan (TW)

(73) Assignees: Chia Her Industrial Co. Ltd. (TW); Yi-Yung Cheng (TW)

( * ) Notice: Subject to any disclaimer, the term of this patent is extended or adjusted under 35 U.S.C. 154(b) by 37 days.

(21) Appl. No.: 13/415,568

(22) Filed: Mar. 8, 2012

(65) Prior Publication Data

US 2012/0231221 A1 Sep. 13, 2012

(30) Foreign Application Priority Data

Mar. 9, 2011 (CN) ..... 2011 2 0060072 U

(51) Int. Cl.
*D03D 13/00* (2006.01)
*D03D 25/00* (2006.01)

(52) U.S. Cl.
USPC ..... 139/420 R; 2/426 R

(58) Field of Classification Search
None
See application file for complete search history.

(56) References Cited

U.S. PATENT DOCUMENTS

| | | | | | |
|---|---|---|---|---|---|
| 1,358,038 | A | * | 11/1920 | Taylor et al. | 139/35 |
| 1,366,705 | A | * | 1/1921 | Rosenstock | 28/156 |
| 1,676,931 | A | * | 7/1928 | Shipway | 139/391 |
| 1,874,320 | A | * | 8/1932 | Matthews et al. | 139/383 R |
| 1,986,686 | A | * | 1/1935 | Stolzenberg | 139/397 |
| 2,137,203 | A | * | 11/1938 | McCullough | 428/93 |
| 2,313,904 | A | * | 3/1943 | Van Brederode | 139/426 R |
| 2,757,437 | A | * | 8/1956 | Faris et al. | 428/141 |
| 4,352,380 | A | * | 10/1982 | Owen et al. | 139/426 R |
| 4,587,153 | A | * | 5/1986 | Sella | 428/196 |
| 5,560,401 | A | * | 10/1996 | Miglus | 139/383 R |
| 6,247,502 | B1 | * | 6/2001 | Ekelund | 139/1 R |
| 6,827,466 | B2 | * | 12/2004 | Tsai | 362/231 |
| 7,575,027 | B2 | * | 8/2009 | Huang | 139/420 R |
| 7,600,473 | B2 | * | 10/2009 | Sheppard, Jr. | 101/483 |
| 2002/0127373 | A1 | * | 9/2002 | Lin | 428/173 |
| 2004/0065380 | A1 | * | 4/2004 | Speich | 139/383 R |
| 2008/0029179 | A1 | * | 2/2008 | Kubota et al. | 139/386 |
| 2008/0163952 | A1 | * | 7/2008 | Huang | 139/317 |

FOREIGN PATENT DOCUMENTS

JP 2001336041 12/2001

* cited by examiner

*Primary Examiner* — Bobby Muromoto, Jr.
(74) *Attorney, Agent, or Firm* — Schmeiser, Olsen & Watts LLP

(57) ABSTRACT

A woven fabric with a color glitter effect is woven from plurality A directional yarn sets and B directional yarn sets perpendicular the A directional yarns, wherein each A directional yarn set includes at least one yarn, a shrinkage of which is more than 3%, and the at least one yarn at least contains two successive organizing points for a downward arrangement when it is woven, such that each B directional yarn set is compressed to form a convex structure and has at least two yarns with different colors, a central level position of one of the at least two yarns of a peak portion of the convex structure, at which the B directional yarn set is located, is higher than a top level position of a lowest yarn of a valley portion of a concave structure, at which the B directional yarn set is located.

12 Claims, 2 Drawing Sheets

WOVEN FABRIC WITH A COLOR GLITTERING EFFECT

BACKGROUND OF THE INVENTION

1. Field of the Invention

The present invention relates to woven fabric, and more particularly to a woven fabric with a concave surface and a convex surface and a color glittering effect.

2. Description of the Prior Art

Conventional woven fabric with a color glittering effect is comprised of waft yarns and weft yarns with different colors, but its color dereference can only be viewed clearly in a large dereference.

JP Pub. No. JP2001336041 discloses that a woven fabric with a color glittering effect has different profiled cross sections, and the profiled cross sections have different optical reflections and scatterings so as to increase color options and the glittering effect. But such a woven fabric can not have an obvious three-dimensional effect, so its glittering effect is poor.

Furthermore, US Pub. No. 2008163952 A1 discloses that a weave with visual color variation has a floating yarn structure, and the floating yarn structure includes yarns with different colors arranged on two sides thereof so that different colors can be viewed from various angles. However, a three-dimensional profile of the floating yarn structure is not obvious, so the color glittering can not be viewed clearly at the same viewing angle.

The present invention has arisen to mitigate and/or obviate the afore-described disadvantages.

SUMMARY OF THE INVENTION

The primary object of the present invention is to provide a woven fabric with a color glittering effect that is capable of overcoming the shortcomings of the conventional woven fabric.

Another object of the present invention is to provide a woven fabric with a concave structure and a convex structure in which two yarns with different colors are provided to generate a color glittering effect.

To obtain the above objectives, a woven fabric with a color glittering effect according to a first embodiment of the present invention is woven from a plurality of A directional yarn sets and a number of B directional yarn sets perpendicular to the plurality of A directional yarns, characterized in that each A directional yarn set includes at least one yarn, a shrinkage of which is more than 3%, and the at least one yarn at least contains two successive organizing points for a downward arrangement when it is woven, such that each B directional yarn set is compressed to form a convex structure and has at least two different color yarns, a central level position of the highest yarn of a peak portion of the convex structure, at which the B directional yarn set is located, is higher than a top level position of a lowest yarn of a valley portion of a concave structure, at which the B directional yarn set is located.

In addition, a woven fabric with a color glittering effect according to a second embodiment of the present invention is woven from a plurality of A directional yarn sets and a number of B directional yarn sets perpendicular to the plurality of A directional yarn sets, characterized in that each A directional yarn set includes a yarn with a higher shrinkage and a yarn with a lower shrinkage, wherein the yarn with the higher shrinkage at least contains two successive organizing points for a downward arrangement when it is woven, such that each B directional yarn set is compressed to generate a convex structure, the B directional yarn set includes at least two different color yarns, a central level position of the highest yarn of a peak portion of the convex structure, at which the B directional yarn set is located, is higher than a top level position of a lowest yarn of a valley portion of a concave structure, at which the B directional yarn set is located.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
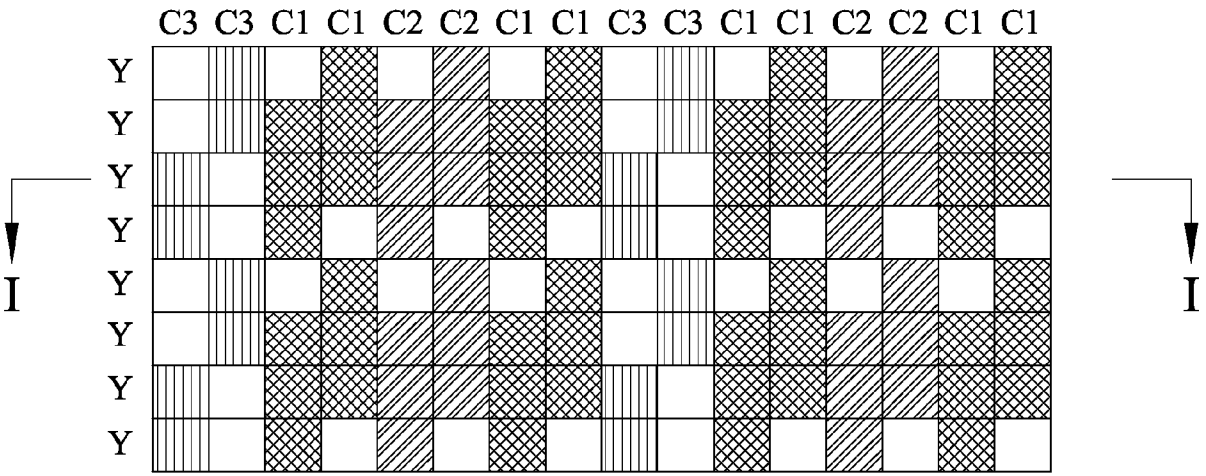
FIG. 1 is a plan view showing the assembly of a woven fabric with a color glitter effect according to a first embodiment of the present invention.
Figure 2:
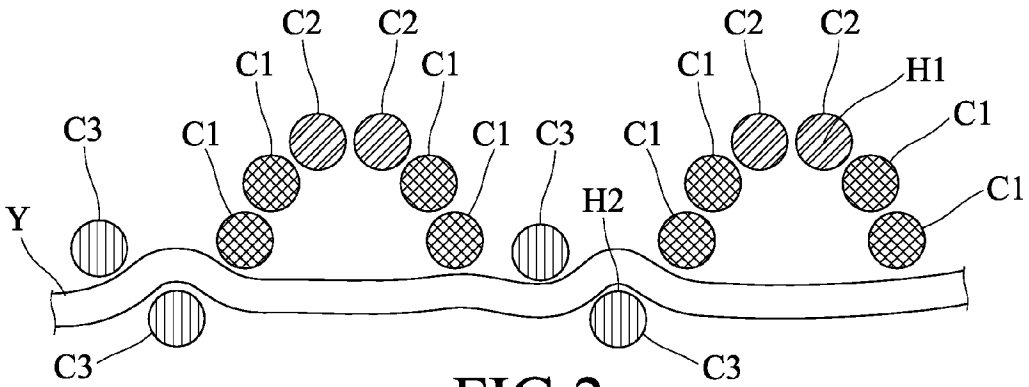
FIG. 2 is a cross sectional view taken along line I-I of FIG. 1.

FIG. 1 is a plan view showing the assembly of a woven fabric with a color glitter effect according to a first embodiment of the present invention. FIG. 2 is a cross sectional view taken along line I-I of FIG. 1. The woven fabric with the color glitter effect is woven from a plurality of A directional yarn sets and a number of B directional yarn sets perpendicular to the plurality of A directional yarns, wherein each A directional yarn set includes at least one yarn Y, a shrinkage of which is more than 3%, and the at least one yarn Y at least contains two successive organizing points for a downward arrangement when it is woven, such that each B directional yarn set is compressed to form a convex structure, so that a central level position H1 of a yarn C2 of a peak portion of the convex structure, at which the B directional yarn set is located, is higher than a top level position H2 of a lowest yarn C3 of a valley portion of a concave structure, at which the B directional yarn set is located, and the B directional yarn set includes at least two yarns C1 and C2, a color of the yarn C1 is different from that of the yarn C2.

The yarn Y is selected from a yarn with more than 3% elasticity shrinkage of or selected from a yarn with more than 3% shrinkage in boiling water so as to generate the concave structure and the convex structure. For example, the yarn Y is a Spantex elastic yarn. If the yarn Y is selected from the yarn with more than 3% shrinkage in boiling water, it generates the concave structure and the convex structure by using a high temperature treatment after being woven. When a color difference of the yarn C1 and the yarn C2 is smaller, a color glitter effect of the woven fabric is poor, so a color difference value $\Delta E$ of the yarn C1 and the yarn C2 is not less than 8.

When the yarn C1 and the yarn C2 are located at an arrangement area of the convex structure, and on a left portion of the arrangement area of the convex structure is provided with at least one yarn C1, on a right portion of an arrangement area of the concave structure is provided with no any yarn C1, the color of the yarn C1 is viewed as viewing from a left side of the woven fabric to a right side of the woven fabric, but the color of the yarn C1 is not viewed as viewing from the right side of the woven fabric to the left side of the woven fabric.

When the yarn C1 and the yarn C2 are located at the arrangement area of the convex structure, and on the left portion and the right portion of the arrangement area of the convex structure is provided with at least one yarn C1, on the leftmost portion and the rightmost portion of the arrangement area of the convex structure is provided with no any yarn C2, the color of the yarn C1 is viewed as viewing from the left side of the woven fabric to the right side of the woven fabric, and the color of the yarn C1 is also viewed as viewing from the right side of the woven fabric to the left side of the woven fabric.

When the yarn C1 is located at the arrangement area of the concave structure, and the yarn C2 is located at the arrangement area of the convex structure, the color glitter effect of the woven fabric generates, but it is not obvious.

At least one of the yarn C1 and the yarn C2 includes different profiled cross sections to have different glosses, thus increasing the color glitter effect. It is to be noted that as a gloss of the yarn C1 is higher but a gloss of the yarn C2 is lower, the better color glitter effect generates.

When the B directional yarn set includes the yarns C1, C2, and C3 with different colors respectively to form different flash colors at two different viewing of the woven fabric. For example, in the arrangement area of the convex structure are provided with at least three yarns C1, C2, C3 of the B directional yarn set having the, wherein the yarn C1 is located at the left portion of the arrangement area of the convex structure, the yarn C2 is located at a middle portion of the arrangement area of the convex structure, and the yarn C3 is located at the right portion of the arrangement area of the convex structure, such that the color of the yarn C1 is viewed as viewing from the left side of the woven fabric to the right side of the woven fabric, and a color of the yarn C3 is viewed as viewing from the right side of the woven fabric to the left side of the woven fabric.

The color difference value ΔE of the yarn C1 and the yarn C2 is measured by rolling the yarns C1 and C2 onto a paperboard, and then testing CIE Lab in a D65 light source by using a Datacolor spectrometer model no. SF600, wherein the color difference value ΔE is a square root of a sum of a ΔL squared+a Δa square+a Δb square.

The colors of the A directional yarn set and the B direction yarn set of the woven fabric are described as follows:

The B direction yarn set is a warp and includes the yarn C1, the yarn C2, and the yarn C3, the color of the yarn C1 is different from that of the yarn C2, and the yarn C3 is not dyed, for example, the yarn C1 is red and its CIE Lab value is L=49.65, a=55.16, and b=27.25, the yarn C2 is black and its CIE Lab value is L=26.46, a=−0.09, and b=−0.99, the color difference value ΔE of the yarn C1 and the yarn C2 is 66.24.

The A direction yarn set is a weft and includes one yarn Y with a 20% elasticity shrinkage, and a weaving structure of the warp and the weft is shown in FIG. 1.

Two different color yarns C1 and yarn C2 are located at the arrangement area of the convex structure, wherein two sets of yarns C1 are located at two sides of the convex structure respectively, and the yarn C2 is located at the middle portion of the convex structure, the yarn C3 not dyed is located at the arrangement area of the concave structure.

As a viewer sees the woven fabric from its left side to its right side, the woven fabric is red, and as the viewer sees the woven fabric from its right side to its left side, the woven fabric is red as well.

Figure 3:
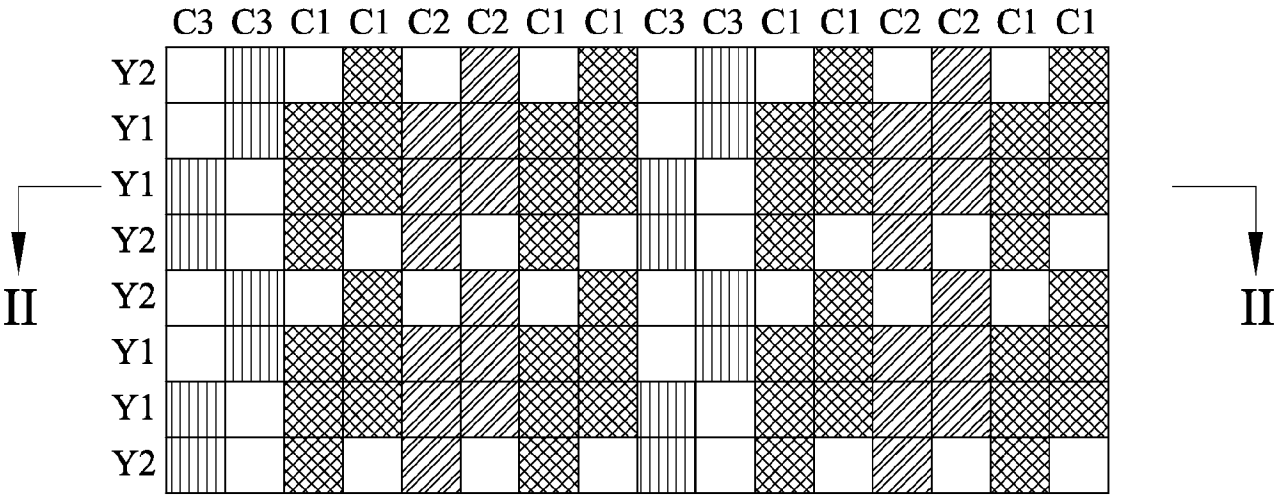
FIG. 3 is a plan view showing the assembly of a woven fabric with a color glitter effect according to a second embodiment of the present invention.
Figure 4:
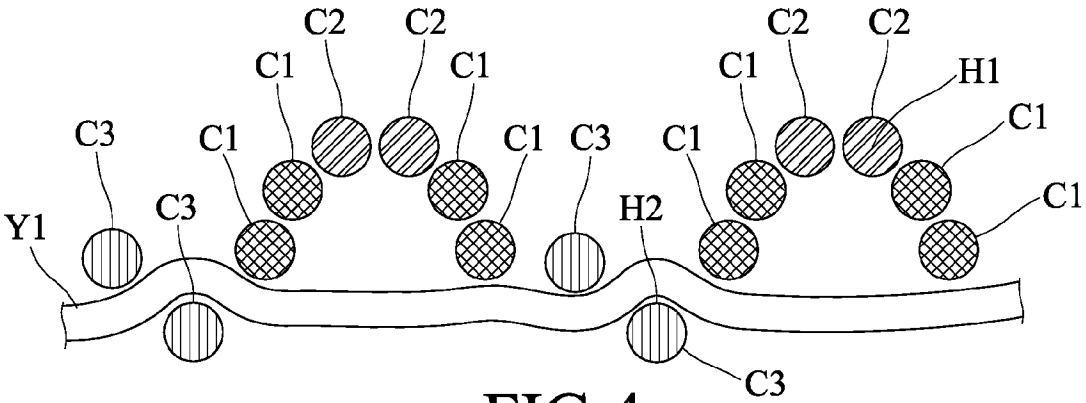
FIG. 4 is a cross sectional view taken along line II-II of FIG. 3.

FIG. 3 is a plan view showing the assembly of a woven fabric with a color glitter effect according to a second embodiment of the present invention. FIG. 4 is a cross sectional view taken along line II-II of FIG. 3. The woven fabric with the color glitter effect is woven from a plurality of A directional yarn sets and a number of B directional yarn sets perpendicular to the plurality of A directional yarn sets, wherein each A directional yarn set includes a yarn Y1 with a higher shrinkage and a yarn Y2 with a lower shrinkage, the yarn Y1 with the higher shrinkage at least contains two successive organizing points for a downward arrangement when it is woven, such that each B directional yarn set is compressed by ways of the higher shrinkage of the yarn Y1 to curve upward, thus obtaining a convex structure. Thereby, the woven fabric has a concave structure and a convex profile. The B directional yarn set includes a yarn C1 and a yarn C2, and a color of the yarn C1 is different from that of the yarn C2.

The yarn Y1 and the yarn Y2 are selected from yarns with different elasticity shrinkages or selected from yarns with different shrinkages in boiling water, if the yarn Y1 and the yarn Y2 are selected from the yarns with different elasticity shrinkages, a difference between the elasticity shrinkages of the yarn Y1 and the yarn Y2 is more than 3% so as to generate the concave structure and the convex structure. For example, the yarn Y1 is a Spantex elastic yarn, and the yarn Y2 is not the Spantex elastic yarn. If the yarn Y1 and the yarn Y2 are selected from yarns with different shrinkages in boiling water, a difference between the shrinkages of the yarn Y1 and the yarn Y2 is more than 3% so as to generate the concave structure and the convex structure by using a high temperature treatment after a weaving process. For instance, the yarn Y1 is high shrinkage polyester fibers, and the yarn Y2 is common polyester fibers.

When a color difference of the yarn C1 and the yarn C2 is smaller, a color glitter effect thereof is poor, so a color difference value ΔE of the yarn C1 and the yarn C2 is not less than 8. An yarn arrangement on the woven fabric of the second embodiment can achieve different three-dimensional effects but with the same color glitter effect as that of the woven fabric of the first embodiment, and then a testing method of a color difference value ΔE and an arrangement of the woven fabric of the second embodiment is the same as the above-mentioned description in the first embodiment.

The colors of the A directional yarn set and the B direction yarn set of the woven fabric are described as follows:

The B direction yarn set is a warp and includes the yarn C1, the yarn C2, and the yarn C3, a color of the yarn C1 is different from that of the yarn C2, and the yarn C3 is not dyed, for example, the yarn C1 is red and its CIE Lab value is L=49.65, a=55.16, and b=27.25, the yarn C2 is black and its CIE Lab value is L=26.46, a=−0.09, and b=−0.99, the color difference value ΔE of the yarn C1 and the yarn C2 is 66.24.

The A direction yarn set is a weft and includes the yarn Y1 and the yarn Y2, an elasticity shrinkage of the yarn Y1 is different from that of the yarn Y2, for example, the elasticity shrinkage of the yarn Y1 is 51%, and the elasticity shrinkage of the yarn Y2 is 26%, a weaving structure of the warp and the weft is shown in FIG. 1.

Two different color yarns C1 and yarn C2 are located at the arrangement area of the convex structure, wherein two sets of yarns C1 are located at two sides of the convex structure respectively, and the yarn C2 is located at the middle portion of the convex structure, the yarn C3 not dyed is located at the arrangement area of the concave structure.

As a viewer sees the woven fabric from its left side to its right side, the woven fabric is red, and as the viewer sees the woven fabric from its right side to its left side, the woven fabric is red as well.

While we have shown and described various embodiments in accordance with the present invention, it is clear to those skilled in the art that further embodiments may be made without departing from the scope of the present invention.

What is claimed is:

1. A woven fabric with a color glitter effect is woven from a plurality of A directional yarn sets and a number of B directional yarn sets perpendicular to the plurality of A directional yarns, characterized in that each A directional yarn set includes at least one yarn (Y), a shrinkage of which is more than 3%, and the at least one yarn (Y) at least contains two successive organizing points for a downward arrangement when it is woven, such that each B directional yarn set is compressed to form a convex structure and has at least two yarns (C1), (C2), a color of the yarn (C1) is different from that of the yarn (C2), a central level position (H1) of the highest yarn of a peak portion of the convex structure, at which the B directional yarn set is located, is higher than a top level position (H2) of a lowest yarn of a valley portion of a concave structure, at which the B directional yarn set is located.

2. The woven fabric with the color glitter effect as claimed in claim 1, wherein an elasticity shrinkage of the at least one yarn (Y) of the A directional yarn set includes is more than 3%.

3. The woven fabric with the color glitter effect as claimed in claim 1, wherein a shrinkage in boiling water of the at least one yarn (Y) of the A directional yarn set includes is more than 3%.

4. The woven fabric with the color glitter effect as claimed in claim 1, wherein in an arrangement area of the convex structure are provided with the at least two different color yarns (C1), (C2) of the B directional yarn sets, and on a left portion of the arrangement area of the convex structure is provided with at least one yarn (C1), on a right portion of an arrangement area of the concave structure is provided with no any yarn (C1).

5. The woven fabric with the color glitter effect as claimed in claim 1, wherein in an arrangement area of the convex structure are provided with at least two different color yarns (C1), (C2) of the B directional yarn sets, and on the left portion and the right portion of the arrangement area of the convex structure are provided with at least one yarn (C1), on the leftmost portion and the rightmost portion of the arrangement area of the convex structure is provided with no any yarn (C2).

6. The woven fabric with the color glitter effect as claimed in claim 1, wherein the yarn (C1) is located at the arrangement area of the concave structure, and another yarn (C2) is located at the arrangement area of the convex structure.

7. A woven fabric with a color glitter effect is woven from a plurality of A directional yarn sets and a number of B directional yarn sets perpendicular to the plurality of A directional yarn sets, characterized in that each A directional yarn set includes a yarn (Y1) with a higher shrinkage and a yarn (Y2) with a lower shrinkage, wherein the yarn (Y1) with the higher shrinkage at least contains two successive organizing points for a downward arrangement when it is woven, such that each B directional yarn set is compressed to generate a convex structure, the B directional yarn set includes at least two yarns (C1), (C2), and a color of the yarn (C1) is different from that of the yarn (C2), a central level position (H1) of the highest yarn of a peak portion of the convex structure, at which the B directional yarn set is located, is higher than a top level position (H2) of a lowest yarn of a valley portion of a concave structure, at which the B directional yarn set is located.

8. The woven fabric with a color glitter effect as claimed in claim 7, wherein the yarn (Y1) of the A directional yarn set has a larger elasticity shrinkage and the yarn (Y2) of the A directional yarn set has a smaller elasticity shrinkage.

9. The woven fabric with a color glitter effect as claimed in claim 7, wherein the yarn (Y1) of the A directional yarn set has a larger shrinkage in boiling water and the yarn (Y2) of the A directional yarn set has a smaller shrinkage in boiling water.

10. The woven fabric with a color glitter effect as claimed in claim 7, wherein in an arrangement area of the convex structure are provided with at least two different color yarns (C1), (C2) of the B directional yarn sets, and on a left portion of the arrangement area of the convex structure is provided with at least one yarn (C1), on a right portion of an arrangement area of the concave structure is provided with no any yarn (C1).

11. The woven fabric with a color glitter effect as claimed in claim 7, wherein in an arrangement area of the convex structure are provided with the at least two different color yarns (C1), (C2) of the B directional yarn sets, and on the left portion and the right portion of the arrangement area of the convex structure are provided with at least one yarn (C1), on a leftmost portion and a rightmost portion of the arrangement area of the convex structure is provided with no any yarn (C2).

12. The woven fabric with a color glitter effect as claimed in claim 7, wherein the yarn (C1) is located at the arrangement area of the concave structure, and another yarn (C2) is located at the arrangement area of the convex structure.

* * * * *